US008713720B2

(12) United States Patent
Bereznai

(10) Patent No.: US 8,713,720 B2
(45) Date of Patent: May 6, 2014

(54) GRAVITY OPERATED MECHANICAL FLUSHING APPARATUS

(75) Inventor: József Bereznai, Budapest (HU)

(73) Assignee: Bery Intellectual Properties Szellemi Tulajdonjogokat Hasznosito es Kezelo Korlatolt Felelossegu Tarsasag, Budapest (HU)

( * ) Notice: Subject to any disclaimer, the term of this patent is extended or adjusted under 35 U.S.C. 154(b) by 213 days.

(21) Appl. No.: 13/393,813

(22) PCT Filed: May 20, 2010

(86) PCT No.: PCT/HU2010/000059

§ 371 (c)(1),
(2), (4) Date: Apr. 30, 2012

(87) PCT Pub. No.: WO2010/133905

PCT Pub. Date: Nov. 25, 2010

(65) Prior Publication Data

US 2012/0233756 A1 Sep. 20, 2012

(30) Foreign Application Priority Data

May 22, 2009 (HU) ..... 0900316

(51) Int. Cl.
*E03D 5/00* (2006.01)

(52) U.S. Cl.
USPC ..... 4/249

(58) Field of Classification Search
USPC ..... 4/249, 303
See application file for complete search history.

(56) References Cited

U.S. PATENT DOCUMENTS 761,278 A * 5/1904 Williams ..... 4/308
1,347,318 A 7/1920 Bender
3,314,084 A * 4/1967 Balikjian ..... 4/249

FOREIGN PATENT DOCUMENTS

FR 998245 A 1/1952

* cited by examiner

*Primary Examiner* — Huyen Le
(74) *Attorney, Agent, or Firm* — Birch, Stewart, Kolasch & Birch, LLP

(57) ABSTRACT

The invention relates to a gravity operated mechanical flushing apparatus, which is operated without any external power source. A weight sensing element (1) provided with a tank (T) contains a component part (8) able to move along a vertical path against a spring force and a controlled feeder valve (5) coupled to a water supply system. The weight sensing element (1) has at its lower end an output (6) able to move vertically causing a mechanical operating event, said output (6) is coupled to a ratchet mechanism (3) through a coupling transmission (2). The ratchet mechanism (3) is able to transmit every second mechanical operating event presented by said output (6) and said transmission (2) to a control element of said controlled feeder valve (5) by means of a further transmission (4) in order to transmit an activating mechanical movement. The controlled feeder valve (5) is coupled to a pipe (17) for filling a determined amount of water for flush from the water supply system into said tank (T) through an outlet (18) of said pipe (17).

3 Claims, 4 Drawing Sheets

GRAVITY OPERATED MECHANICAL FLUSHING APPARATUS

The invention relates to a gravity operated mechanical flushing apparatus, more particularly to an automatic apparatus operated by gravitational force without requiring a power source for allowing flush by means of a controlled valve coupled to a pressurized water supply system. Such apparatus is applicable for use in urinals (called also pissoir) or even in toilet bowls especially in washdown type models.

In many cases the above mentioned urinals generally use an automatically operated flush system based on infrared detection. However, this may be sensitive to optical contaminations and damages, therefore malfunction may occur. To eliminate this problem even complicated radar systems which are more resistive to damages are used in urinals, but this solution is rather expensive. A disadvantage of either of these solutions is that they require external power source, e.g. electric current. In many cases supply of electric current in damp rooms, e.g. bathrooms, toilets raises difficulties since proper wiring is not always ensured. Post-wiring is usually cumbersome and expensive considering the safety regulations relating to damp environment. In particular cases (e.g. lay-bys or rest areas along motorways, toilets along a forest path, mobile toilets) there is only water available while electric current is not. The main problem with battery supplied current is that the batteries must be recharged, they are difficult to install and their lifetime is relatively short.

Resulting from the above an automatic flushing apparatus is needed especially in case of urinals which apparatus does not require electric or other external power source, fully automatic and can be operated reliably.

It has been realized that vertical displacement against a spring force due to gravitational force is an applicable automatism through which a water feeding valve can be operated.

The invention will be described with reference to the attached drawings where:

FIG. 1 schematically shows an arrangement of one embodiment of the invention with its main elements;

Figure 1:
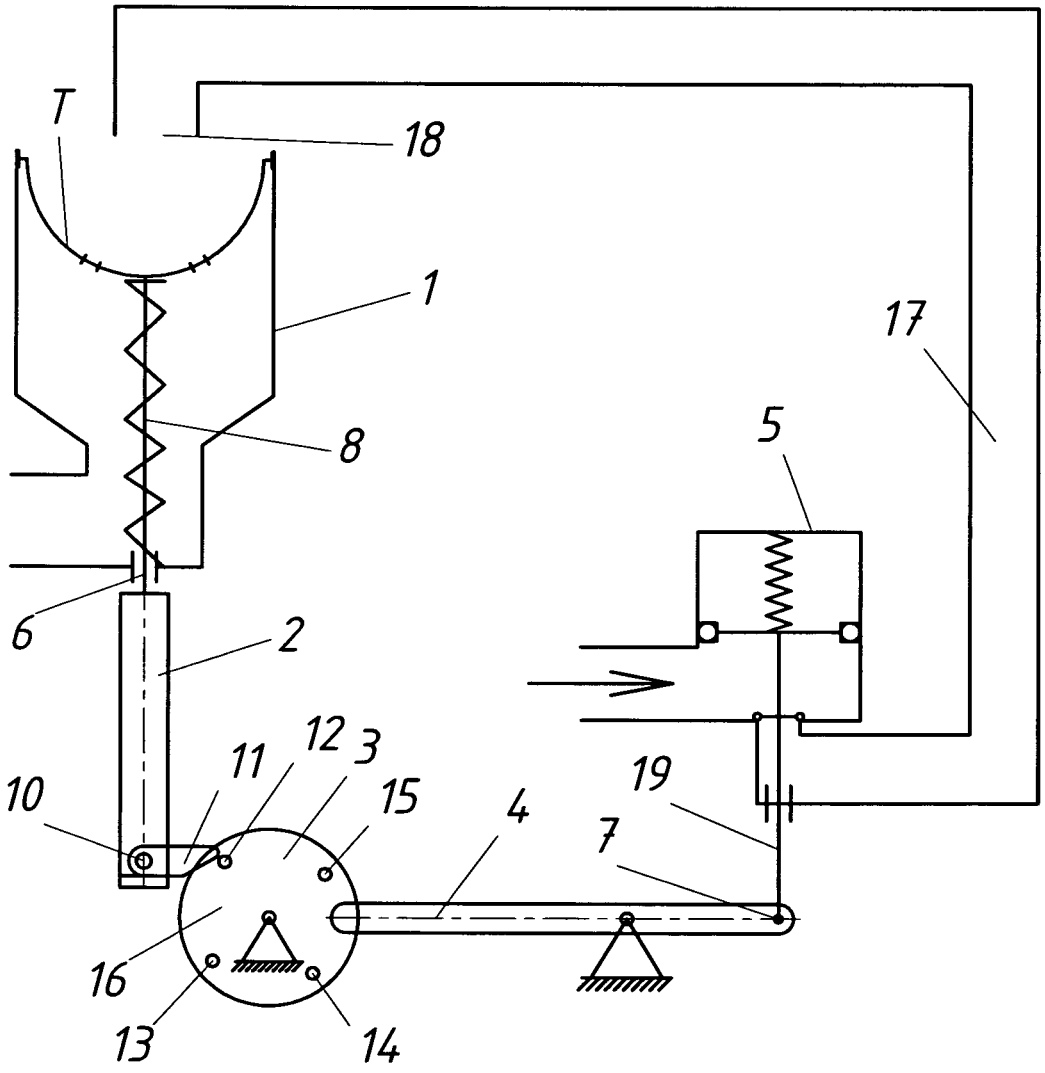

A schematic arrangement of one embodiment of the invention is shown in FIG. 1. A weight sensing element 1 comprises a component part 8 which is able to move against a spring force along a vertical path. Preferably, component part 8 comprises a pre-stressed spring and a directing element which moves along a vertical path. If something e.g. liquid flows into tank T of weight sensing element 1 component part 8 will be pressed causing displacement at the output 6 at the lower end of the weight sensing element 1, which then returns to its initial position due to the springy mechanism of component part 8. This happens because the liquid is able to flow out slowly (substantially slower than it is filled in) through the opening(s) formed at the lower part of the tank. Hereinafter this cycle is referred to as mechanical operating event. This displacement is coupled through output 6 of weight sensing element 1 and a joining transmission 2 to a ratchet mechanism 3 at the output 7 of transmission 4. This transmission 4 may be a simple rod or a jointed arm suitable for allowing ratchet mechanism 3 to move in one direction. This may be realized by means of a blocking element (not shown) within the ratchet mechanism 3 and crossbar pins 12, 13, 14, 15 abutting against the end of transmission 2 being opposite to output 6. In an alternative embodiment cams, teeth, etc. may be used. Further, instead of having two pairs of engaging element there may be several pairs on the disc. Ratchet mechanisms of this kind are widely used. Ratchet mechanism 3 is able to transmit an activating mechanical movement on every second mechanical operating event effected by transmission 2 to a controlled feeder valve 5. This movement is transmitted by means of transmission 4 which is different from transmission 2. The difference is that transmission 2 transmits each of the mechanical operating events present on output 6 of weight sensing element 1 to ratchet mechanism 3, while transmission 4 transmits only every second of these mechanical operating events to controlled feeder valve 5. This is called activating mechanical movement. The importance of this is that when some material especially liquid flows into weight sensing element 1, tank T of weight sensing element 1 and also its output 6 move vertically downwards, against the spring. Then controlled feeder valve 5 is activated through transmissions 2 and 4 and a predetermined amount of water is fed for flush from the water supply system. This amount of water again activates weight sensing element 1 in like manner, but it is not transmitted to the input of controlled feeder valve 5 through transmissions 2, 4 and ratchet mechanism 3. Therefore another flush does not take place. If water supply is temporary blocked for some reason then the second cycle is omitted, but this only means that flush can not be accomplished because the lack of water. When water is again available from the water supply system, on vertical downward movement of weight sensing element 1, i.e. when the urinal or toilet is again used, then controlled feeder valve is operated for a new flush by transmissions 2, 4 and ratchet mechanism 3. Thus when water-pressure is restored the process is restarted and the apparatus operates continuously. If the process is interrupted as a result of other failure, automatism is restored in the same manner as soon as the failure is eliminated.

As it was supposed previously, controlled feeder valve 5 is coupled to a water supply system. This may be a public water supply system or a pressurized local system. Alternatively, the water supply system may be passive, e.g. a water tank positioned high above which can hold enough flush-water for use for a long time. In this case the flushing system can be make independent of the electric network and the water supply system, too. It should be noted that by using a desilter or closed tank the apparatus may be made independent of the public utilities and energy supply.

Figure 2:
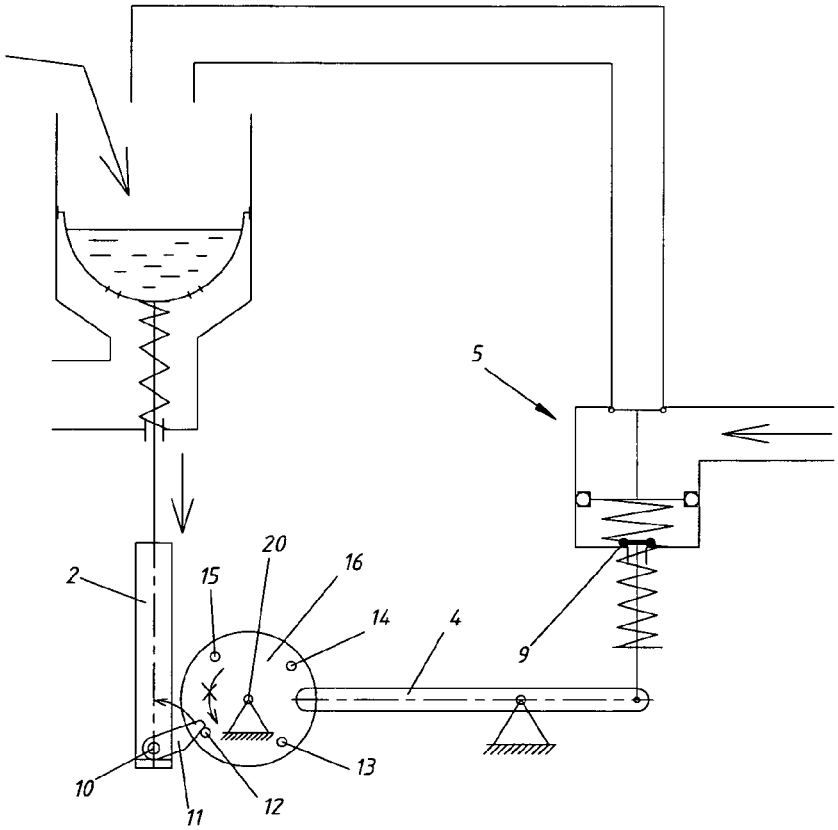
FIG. 2 shows the front-view of the mechanical transmission according to the invention in a first position.
Figure 3:
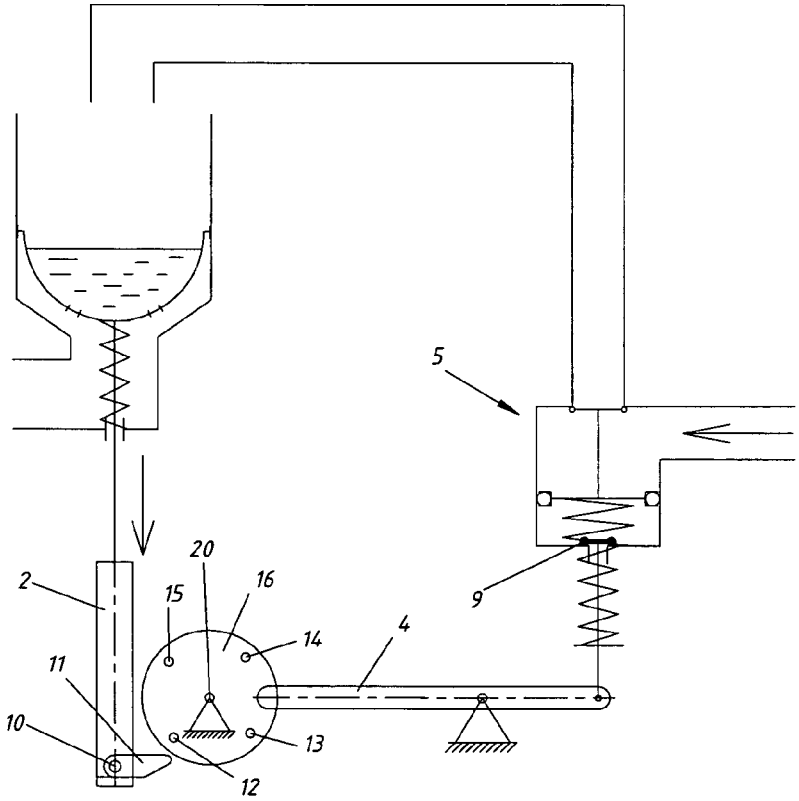
FIG. 3 shows the front-view of the mechanical transmission according to the invention in a second position.

In one embodiment of the invention weight sensing element 1 comprises a tank T in which liquid is entered. This can be for example urine produced during use of the urinal. This liquid may be led away in a slow manner e.g. through small bore-holes or through a valve, and normally it is collected in tank T of weight sensing element 1 as a result of which tank T moves vertically downwards against the spring within component part 8. The spring has a suitable pre-stressing force which may be determined experimentally. A mechanical means mounted on it forms output 6. When it moves, the movement is transmitted to ratchet mechanism 3 through transmission 2. According to an embodiment shown in FIG. 2 transmission 2 has a plate 11 which is able to turn in one direction (upwards) around a shaft 10. When plate 11 turns around the shaft it tilts over the adjacent stud 12 which is parallel with shafts 10 and 20. Studs 12, 13, 14 and 15 are positioned symmetrically on disc 16 or between a pair of discs 16 perpendicular to their surfaces thereby forming ratchet mechanism 3. During a mechanical operating event, that is when output 6 moves downwards, plate 11 tilts over stud 12 and returns to its initial position somewhere under stud 12 as it is shown in FIG. 3. In the second cycle of the mechanical operating event when output 6 moves vertically upwards, plate 11 is not able to move around shaft 10 so the structure forms a ratchet mechanism 3 which gets caught by stud 12 and rotates disc 16 by a quarter. With plate 11 and studs 12-15 this structure ensures that each of the mechanical operating events is accomplished in the same manner. In this example it means that the disc is rotated to the right by a quarter of a turn each time.

Figure 4:
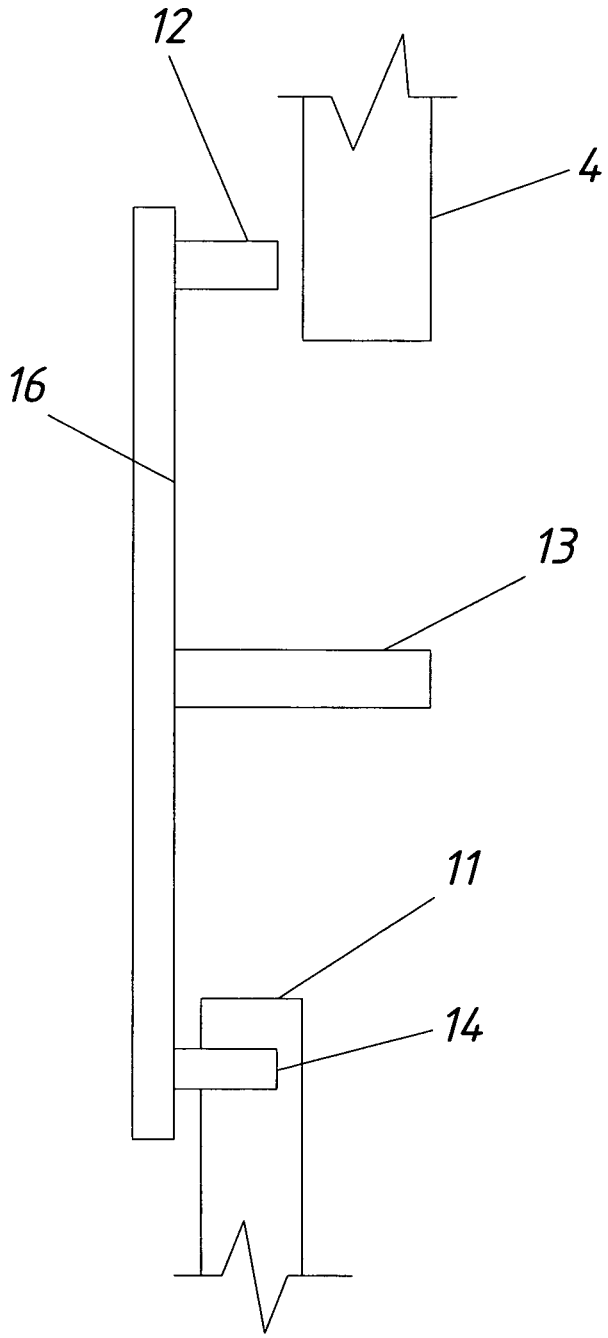
FIG. 4 shows the side view of one embodiment of the mechanical transmission according to the invention.

Transmission 4 up to the feeder valve 5 including an auxiliary valve 9 may be realized by a transmission structure 4 which engages with studs 12-15 on the other half (in FIG. 2 the right-hand side) of disc 16. In this case plate 11 only gets caught by every second stud, for example studs 12 and 14. This can be accomplished by positioning transmission 4 further than plate 11 from the surface of disc 16 while studs 12 and 14 protrude from disc 16 to a greater extent than studs 13 and 15. This is shown in FIG. 4. In this manner only every second mechanical operating event presenting on output 6 is transmitted to the input of controlled feeder valve 5 for its mechanical operation. On a single activating mechanical event controlled feeder valve 5 is applicable to feed water through a predetermined period of time or to feed a predetermined amount of water to the flush-pipe of a urinal for flush. Preferably, controlled feeder valve 5 is a feeder valve described in international patent application WO 03/031850 (assigned to the same applicant) which is incorporated here by reference. Feeding is caused by the mechanical effect exerted on valve stem 19 of controlled feeder valve 5.

Ratchet mechanism 3 and accordingly transmissions 2 and 4 may be realized differently from the above described embodiment. Any solution may be suitable which elicits an asymmetric control, that is, elicits an activating mechanical movement on every second mechanical operating event. In another approach ratchet mechanism and transmissions 2 and 4 form a mechanical divide-by-2 divider.

From the pressurized water supply system an amount of water is fed for flush by controlled feeder valve 5 for a given period of time. This water flows into tank T through outlet 18 of pipe 17. The amount of water used for flush can be predetermined by adjustment of controlled feeder valve 5. Outlet 18 is positioned above tank T. The pressure present in the water supply system makes water flow into tank T.

In FIGS. 5A-5I the stages of operation according to one typical embodiment of the invention can be seen.

Figure 5A:
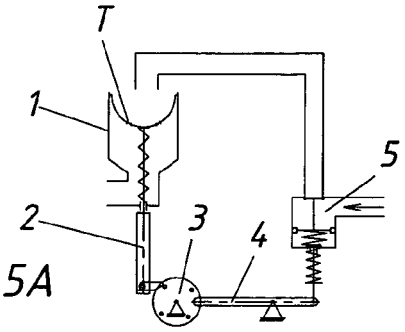
FIGS. 5A-5I show the stages of operation according to one embodiment of the invention.

FIG. 5A shows the initial position of weight sensing element 1 with tank T which is mechanically coupled to the control shaft of controlled feeder valve 5 through transmission 2, ratchet mechanism 3 and transmission 4. An auxiliary valve as shown in FIGS. 2 and 3 is applied in the controlled feeder valve.

Figure 5E:
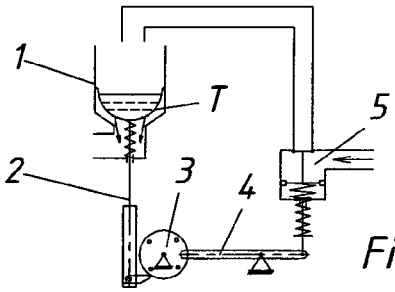
Figure 5B:
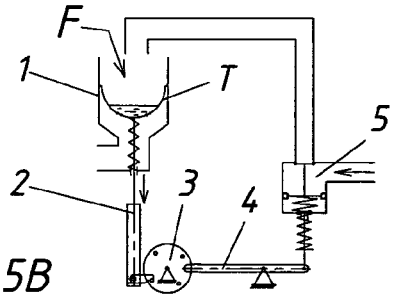

In FIG. 5B liquid F enters into tank T as a result of which it is lowered and makes transmission 2 move vertically downwards. Then transmission 2 tilts over one of the studs of ratchet mechanism 3 as it is shown in FIG. 5C. Then the end part of transmission 2 returns to its initial position as it is seen in FIG. 5D.

In FIG. 5E the cumulated liquid F leaves tank T through the small opening or openings formed at the bottom part of it. Leaving of liquid F from tank T is performed at a lower speed than it is filled in. The effective size of the opening may vary depending on the position of the moving tank T. For example when tank T moves upwards from its lower position, the opening may be a growing valve opening.

Figure 5F:
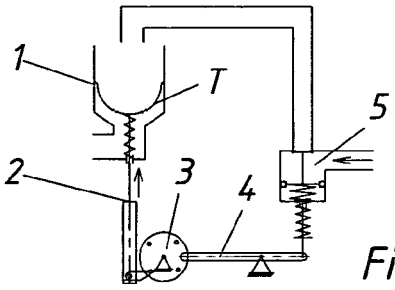
Figure 5C:
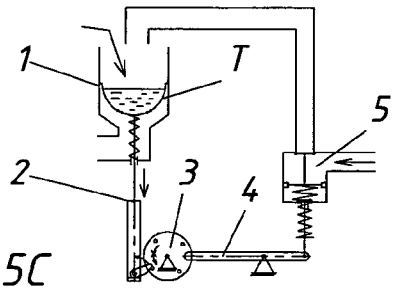

According to FIG. 5F the spring under tank T forces tank T to move back to its original position.

Figure 5G:
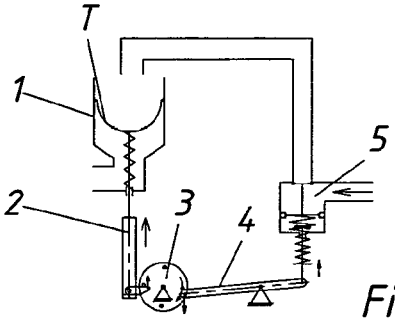
Figure 5D:
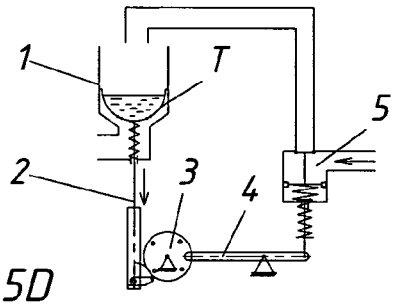

FIG. 5G shows that on its way back transmission 2 is caught by one of the studs of ratchet mechanism 3 as a result of which ratchet mechanism 3 is rotated clockwise and by means of transmission 4 valve stem of controlled feeder valve 5 opens.

Figure 5H:
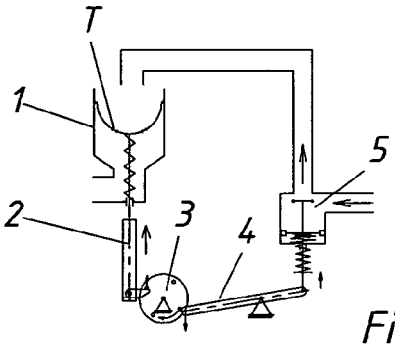

According to FIG. 5H controlled feeder valve 5 opens and feeds water into tank T in a direction shown by the arrow.

Figure 5I:
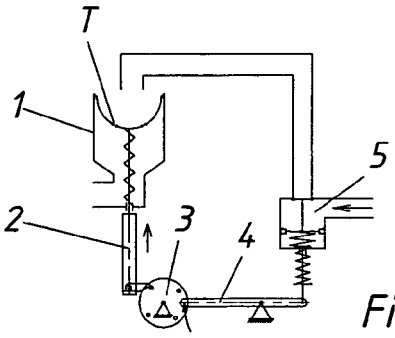

According to FIG. 5I the initial position is re-established and after a given period of time, i.e. after the water used for flush is let pass through, controlled feeder valve 5 is shut down.

FIG. 5A-5I illustrate a half period of the cycle of operation, in the other half period transmission 4 is not driven when ratchet mechanism 3 rotates a quarter of a turn. In this half period water flowing into tank T makes tank T move in the same way as in case of FIGS. 5A, 5B, but—differently from FIG. 5D—when it is emptied transmission of movement does not take place through transmission 4 as shown in FIG. 5G.

In this exemplary embodiment of ratchet mechanism 3 when the water for flush leaves, the end of transmission 4 meets a short stud. As it does not reach this stud it will not drive it, therefore when the water leaves tank T further flush is not effected. This is an important feature in case of urinals.

So called washdown toilets may be operated in a similar manner, where a permanent space for liquid is present and increase in the weight of the liquid triggers the operation of the system. This may be the mechanical operating event. Naturally, increase in weight may originate from other substance not only liquid. In this case the mechanism for control and operation may be a similar weight sensing element present in the permanent space for liquid where emptying is delayed. Preferably, when the flushing apparatus according to the invention is used with washdown toilets, a float structure applied in conventional toilet tanks is used. This in case of continuous rising of the liquid level ensures that after reaching a predetermined level this level is maintained standard by means of a relatively large drainpipe.

In case of washout toilet bowls a more complicated non-liquid loaded weight sensing element 1 must be used. The essence of the mechanism may be similar.

The present invention may be used with other systems designed for flush, e.g. special sinks, wash-hand basins or for washing technological basins of chemical works after use.

The invention claimed is:

1. A gravity operated mechanical flushing apparatus having a weight sensing element (1) provided with a tank (T) containing a component part (8) able to move along a vertical path against a spring force and a controlled feeder valve (5) coupled to a water supply system characterized in that said weight sensing element (1) has at its lower end an output (6) able to move vertically causing a mechanical operating event, said output (6) is coupled to a ratchet mechanism (3) through a coupling transmission (2), said ratchet mechanism is able to transmit every second mechanical operating event presented by said output (6) and said transmission (2) to a control element of said controlled feeder valve (5) by means of a further transmission (4) in order to transmit an activating mechanical movement, said controlled feeder valve (5) is coupled to a pipe (17) for filling a determined amount of water for flush from the water supply system into said tank (T) through an outlet (18) of said pipe (17).

2. Flushing apparatus according to claim 1 characterized in that it comprises a controlled feeder valve (5) coupled to a pressurized water supply system.

3. Flushing apparatus according to claim 1 characterized in that said ratchet mechanism (3) comprises one or more discs (16) with studs (12, 13, 14, 15) perpendicular to said disc(s) (16) and the apparatus is provided with an input transmission (2) the end of which is able to engage with all of said studs and an output transmission (4) the end of which is able to engage with every second studs (13, 15).

* * * * *